US006402629B1

(12) United States Patent
Heddon

(10) Patent No.: US 6,402,629 B1
(45) Date of Patent: Jun. 11, 2002

(54) RETRACTABLE BOWLING ALLEY BUMPER SYSTEM

(76) Inventor: Will Heddon, P.O. Box 628, Lake Hamilton, FL (US) 33851-0628

( * ) Notice: Subject to any disclaimer, the term of this patent is extended or adjusted under 35 U.S.C. 154(b) by 0 days.

(21) Appl. No.: 09/885,562

(22) Filed: Jun. 20, 2001

Related U.S. Application Data

(60) Provisional application No. 60/212,537, filed on Jun. 20, 2000.

(51) Int. Cl.[7] ..... A63D 5/00
(52) U.S. Cl. ..... 473/55; 473/113
(58) Field of Search ..... 473/54, 55, 106, 473/113, 115

(56) References Cited

U.S. PATENT DOCUMENTS

| | | | |
|---|---|---|---|
| 4,900,024 | A | 2/1990 | Chandler et al. |
| 5,181,716 | A | 1/1993 | Stephens |
| 5,207,422 | A | 5/1993 | Beene |
| 5,304,097 | A | 4/1994 | Duff |
| 5,322,476 | A | 6/1994 | Wortman |
| 5,358,448 | A | 10/1994 | Stephens |
| 5,405,295 | A | 4/1995 | Lord |
| 5,415,591 | A | 5/1995 | Beene |
| 5,417,616 | A | 5/1995 | Widrick |
| 5,435,788 | A | 7/1995 | Duff |
| RE35,232 | E | 5/1996 | Stephens |
| 5,564,986 | A | 10/1996 | Gretzky et al. |
| 5,681,224 | A | 10/1997 | Higashi |
| 5,800,274 | A | 9/1998 | Widrick et al. |
| 5,857,918 | A | 1/1999 | Beene |

*Primary Examiner*—William M. Pierce
(74) *Attorney, Agent, or Firm*—Saliwanchik, Lloyd & Saliwanchik

(57) ABSTRACT

The bumper system of the subject invention prevents a bowling ball from entering the gutters, redirecting the ball into the lane. The bumper system comprises a longitudinal rail with a plurality of pivot arms affixed thereto. The bumper system is pivotally affixed it the lane bed such that when the bumper system is in a retracted position the horizontal surface of the longitudinal rails are in a substantially abutting relation to the side of the lane, and the adjacent gutters are adapted to receive any balls that are bowled towards either side of the lane, directing the balls to the end of the lane, missing the pin deck. In an extended position, the longitudinal rails prevent balls from entering the adjacent gutters, redirecting balls into the lane, such that the balls strike the pins in the pin deck.

15 Claims, 7 Drawing Sheets

RETRACTABLE BOWLING ALLEY BUMPER SYSTEM

CROSS-REFERENCE TO A RELATED APPLICATION

This application claims the benefit of U.S. Provisional Application No.60/212,537, filed Jun. 20, 2000.

BACKGROUND OF THE INVENTION

1. Field of the Invention

The present invention relates to a retractable bowling alley bumper system for preventing bowling balls from entering the gutters.

2. Description of the Related Art

In a conventional bowling alley, a bowling ball not directed down the center portion of the lane can fall into the gutter, resulting in a gutter ball and no pins knocked down. While the gutters provide boundaries with which skilled players can test the limits of their game, they can also be very discouraging to inexperienced, young, or handicapped bowlers who may throw frame after frame of gutter balls resulting in a low score or no score at all.

In an effort to open up the game to more people and to make it more enjoyable, bumper systems have been developed which prevent a bowling ball from entering the gutter. In such systems, an elongated longitudinal guard is placed along the length of the gutter. The longitudinal guard prevents a bowling ball from entering the gutter, keeping the ball in the lane.

However, early bumper systems were difficult to set-up and often resulted in the designation of a lane as a bumper bowling only lane. As such, this limited the availability of both conventional and bumper lanes, as well as limiting the prospects of a group of bowlers of varying degrees of skill and physical ability to play together.

Accordingly, retractable bumper systems have been developed which permit the longitudinal guard to be easily deployed or retracted, depending on the skill or physical ability of the player. A variety of such retractable bumper systems have been described, for example in: U.S. Pat. No. 4,900,024; U.S. Pat. No. 5,181,716; U.S. Pat. No. 5,207,422; U.S. Pat. No. 5,304,097; U.S. Pat. No. 5,322,476; U.S. Pat. No. 5,358,448; U.S. Pat. No. 45,405,295; U.S. Pat. No. 5,415.591; U.S. Pat. No. 5,417,616; U.S. Pat. No. 5,435,788; U.S. Pat. No. RE. 35,232; U.S. Pat. No. 5,564,986; U.S. Pat. No. 5,681,224; U.S. Pat. No. 5,800,274; and U.S. Pat. No. 5,857,918.

BRIEF SUMMARY OF THE INVENTION

A conventional bowling alley typically comprises a longitudinally extending lane, disposed over a lane bed, defining a flat horizontal surface. A foul line extends across one end of the lane, perpendicular to the longitudinal axis of the lane. The opposite end of the lane comprises a pin deck adapted to receive a plurality of bowling pins thereon. A pair of longitudinally extending gutters is disposed along and in a substantially abutting relation to the sides of the lane, with one gutter on each side of the lane. The gutters are adapted to receive any balls that are bowled towards either side of the lane, directing the balls to the end of the lane, missing the pin deck.

The bumper system of the subject invention prevents a ball from entering the gutter, instead redirecting the ball into the lane. The bumper system comprises a longitudinal rail with a plurality of pivot arms affixed thereto.

Each pivot arm comprises an upper end and a lower end, where the upper end is pivotally connected to the longitudinal rail with a pin, shaft, or other similar connection device. The lower end of the pivot arm comprises an integrated bushing, where the integrated bushing is disposed between the pivot arm and the lane.

The longitudinal rail comprises a u-shaped rail, comprising a pair of parallel vertical sides members connected to a horizontal top member, forming an open bottom end. The upper end of the pivot arm is inserted into and pivotally connected within the open end of the u-shaped rail.

The bumper system is affixed to the bowling alley by forming a vertical surface in the lane bed longitudinally along the sides of the lane. In existing lanes, that portion of the gutter abutting the side of the lane is removed, exposing the side of the lane bed, forming the vertical side surface. The bumper system is pivotally affixed to the vertical side surface of the lane bed by positioning the lower end of the pivot arm against the vertical side surface, where the integrated bushing is interposed between the pivot arm and the vertical side surface. The pivot arm is pivotally affixed to the vertical side surface of the lane bed by a pin, shaft, or other similar connection device so as to move in paired unison with the displacement of the longitudinal rail. In this manner, the longitudinal rails can be displaced between the retracted position for exposing the adjacent gutter and the fully extended position guarding the adjacent gutter.

The pivot arm is positioned along the vertical side surface of the lane bed such that when the bumper system is in a retracted position the horizontal surface of the longitudinal rails are in a substantially abutting relation to the side of the lane, such that the adjacent gutters are adapted to receive any balls that are bowled towards either side of the lane, directing the balls to the end of the lane, missing the pin deck. In an extended position, the longitudinal rails prevent balls from entering the adjacent gutters, redirecting balls into the lane, such that the balls strike the pins in the pin deck.

The bumper system is extended by manually displacing the longitudinal rails, which rotates the attached pivot arms. The longitudinal rails are displaced until the pivot arms engage the stop mechanism. The stop mechanism comprises a shaft inserted into the vertical side surface of the lane bed, thereby limiting the rotation of the pivot arms to that of slightly greater than ninety degrees.

These and other features of the present invention will be more readily understood with reference to the following detailed description, read in conjunction with the accompanying drawing figures.

DETAILED DISCLOSURE OF THE INVENTION

Figure 1:
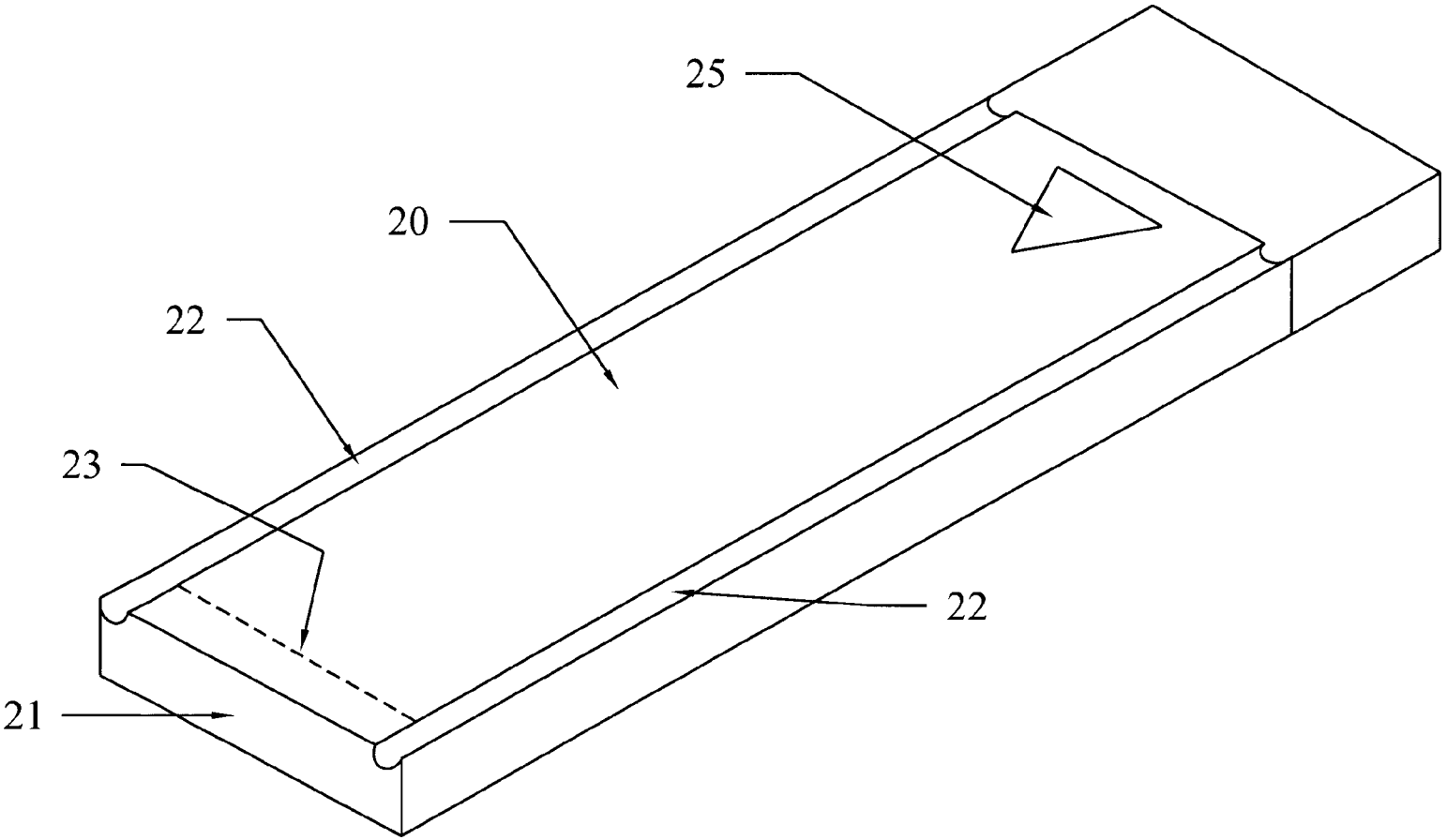
FIG. 1 depicts a perspective view of a conventional bowling alley.
Figure 2:
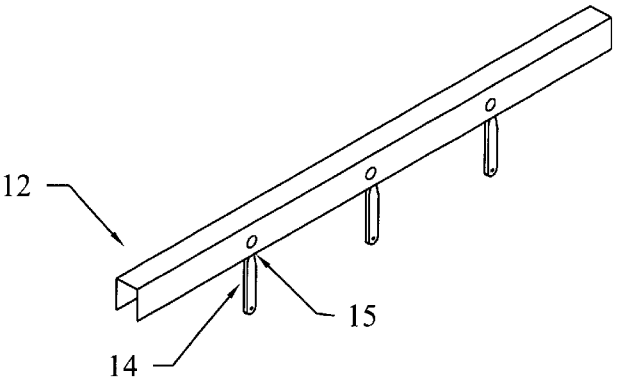
FIG. 2 depicts a perspective view of the bumper system of the subject invention.
Figure 3:
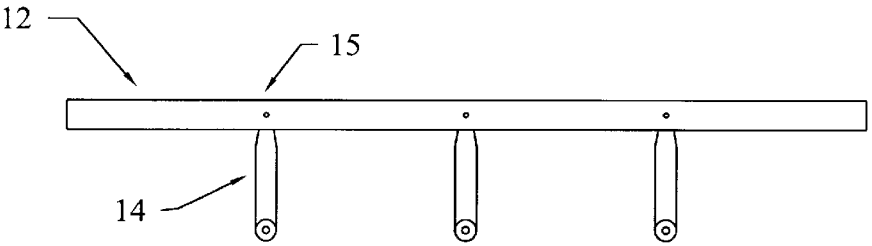
FIG. 3 depicts a side view of the bumper system of the subject invention in an erect position.
Figure 4:
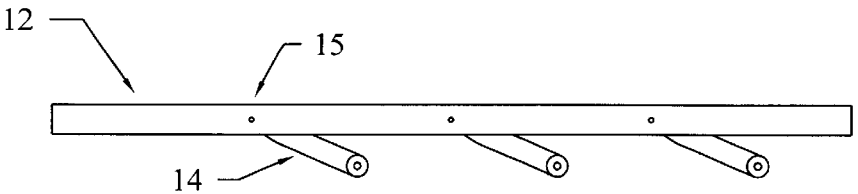
FIG. 4 depicts a side view of the bumper system of the subject invention in a retracted position.

As shown in FIG. 1, a conventional bowling alley 19 typically comprises a longitudinally extending lane 20, disposed over a lane bed 21, defining a flat horizontal surface. A foul line 23 extends across one end of the lane 20, perpendicular to the longitudinal axis of the lane 20. The opposite end of the lane 20 comprises a pin deck 25 adapted to receive a plurality of bowling pins thereon. A pair of longitudinally extending gutters 22 is disposed along and in a substantially abutting relation to the side of the lane 20, with one gutter 22 on each side of the lane 20. The gutters 22 are adapted to receive any balls that are bowled towards either side of the lane 20, directing the balls to the end of the lane 20, missing the pin deck 25.

The bumper system 10 of the subject invention prevents a ball from entering the gutter 22, redirecting the ball into the lane 20. As shown in FIGS. 2–6, the bumper system 10 comprises a longitudinal rail 12 with a plurality of pivot arms 14 affixed thereto.

Figure 5:
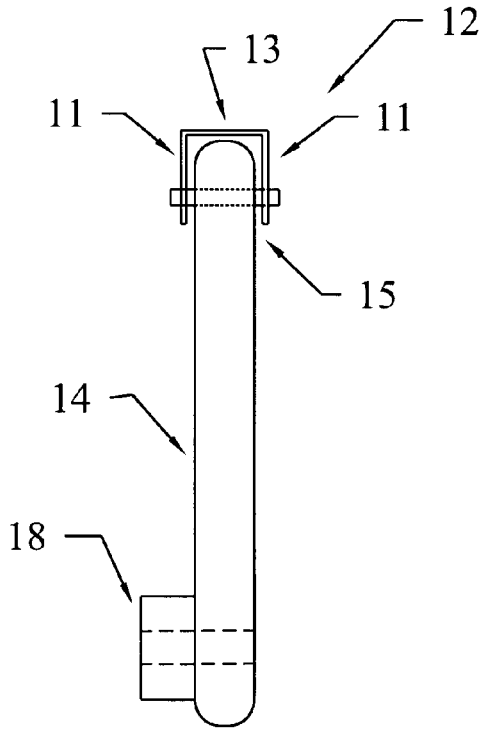
FIG. 5 depicts a front view of the bumper system of the subject invention in an erect position.
Figure 6:
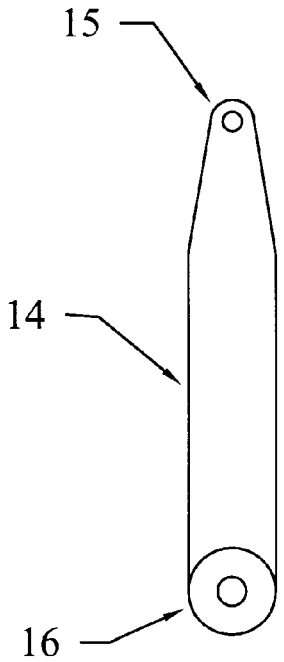
FIG. 6 depicts a side view of a pivot arm.

The pivot arm 14, as shown in FIGS. 5 and 6, comprises an upper end 15 and a lower end 16, where the upper end 15 is pivotally connected to the longitudinal rail 12 with a pin, shaft or other similar connection device. The lower end 16 of the pivot arm 14 comprises an integrated bushing 18, where the integrated bushing 18 is disposed between the pivot arm 14 and the lane 20.

In one embodiment, the pivot arms 14 are made from a resilient semi-rigid material. When a bowling ball strikes a longitudinal rail 12 the resilient pivots 14 will display an elastic deformation, deflecting from and returning to and an equilibrium position.

In an embodiment, the pivot arms 14 are made from a plastic, anodized rubber, carbon composite, or other similar semi-rigid material.

In an alternative embodiment, the pivot arms 14 are impregnated with a luminescent, phosphorescent, or other light emitting material.

In an embodiment as shown in FIG. 5, the longitudinal rail 12 comprises a u-shaped rail comprising a pair of parallel vertical sides members 11 connected to a horizontal top member 13, forming an open bottom end 17. The upper ends 15 of the pivot arms 14 are inserted into and pivotally connected within the open end 17 of the u-shaped rail 12.

Figure 7:
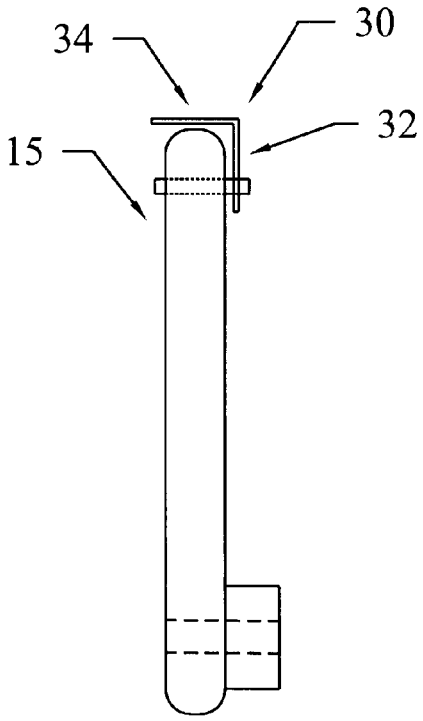
FIG. 7 depicts a front view of an L-shaped longitudinal rail.

In an alternative embodiment, as shown in FIG. 7, the longitudinal rail 12 comprises an L-shaped rail 30, comprising a vertical side member 32 and horizontal top member 34. The upper ends 15 of the pivot arms 14 are pivotally connected to the vertical side member 32 of the L-shaped rail 34 such that vertical side member 32 is directed into the lane 20.

In an embodiment, the longitudinal rail 12 is made from aluminum, plastic, carbon composite, or other similar materials which provide rigidity and durability.

In an alternative embodiment, the longitudinal rail 12 is impregnated, coated, or otherwise comprises luminescent, phosphorescent, or other light emitting material.

In an embodiment, the bumper system 10 comprises a single longitudinal rail 12 with a plurality of pivot arms 14 thereto, wherein the longitudinal rail 12 has a length substantially equal to the longitudinal length of tie lane 20.

In an alternative embodiment, the bumper system 10 comprises a plurality of longitudinal rails 12 connected in series, where the sum of the lengths of the connected longitudinal rails 12 is substantially equal to the longitudinal length of the lane 20.

Figure 8:
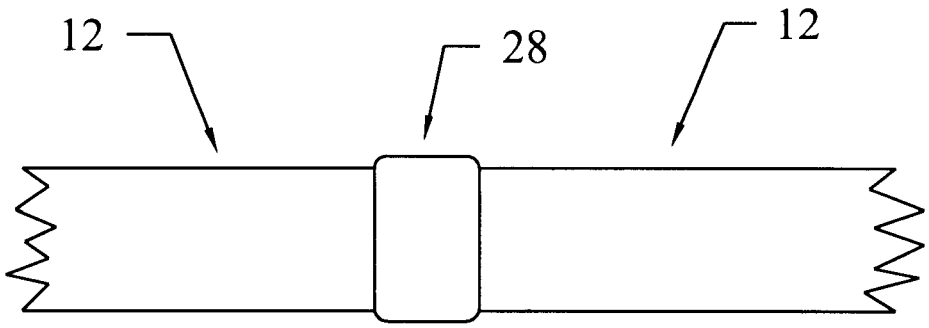
FIG. 8 depicts a side view of a pair of connected longitudinal rails.
Figure 9:
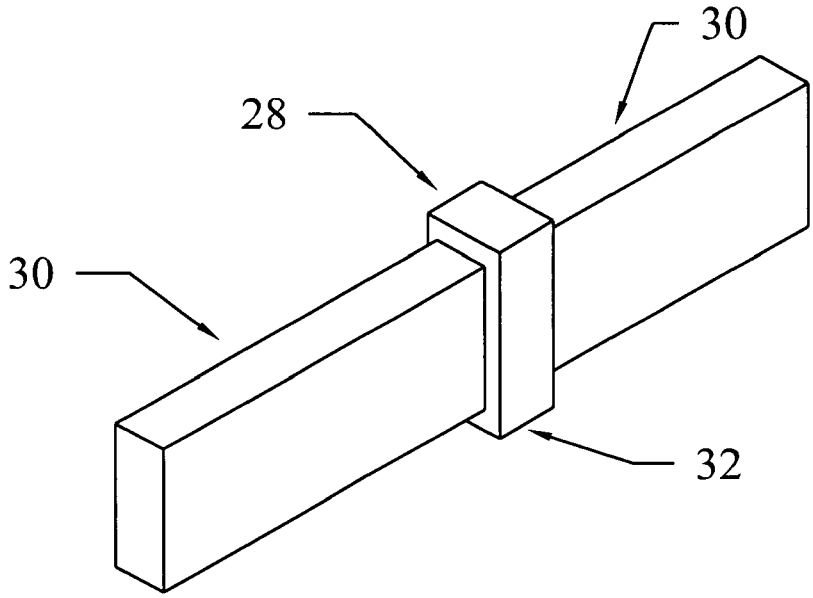
FIG. 9 depicts a perspective view of a connector plug.

In an embodiment, as shown in FIG. 8 and 9, tie longitudinal rails 12 are connect by affixing a connecting plug 27 into the ends of the longitudinal rails, where a first end 28 of the connecting plug 27 is affixed into the end of a first longitudinal rail 12, and a second end 29 of the connecting plug 27 is affixed into die end of the adjacent longitudinal rail 12. The connection plug 27 is secured to the longitudinal rails 12 by a screw or other similar securing devices.

In a particular embodiment wherein a plurality of longitudinal rails 12 are connected by connecting plugs 27, such as that depicted in FIGS. 8 and 9, the longitudinal rail 12 has a length of about one hundred sixteen inches.

Figure 10:
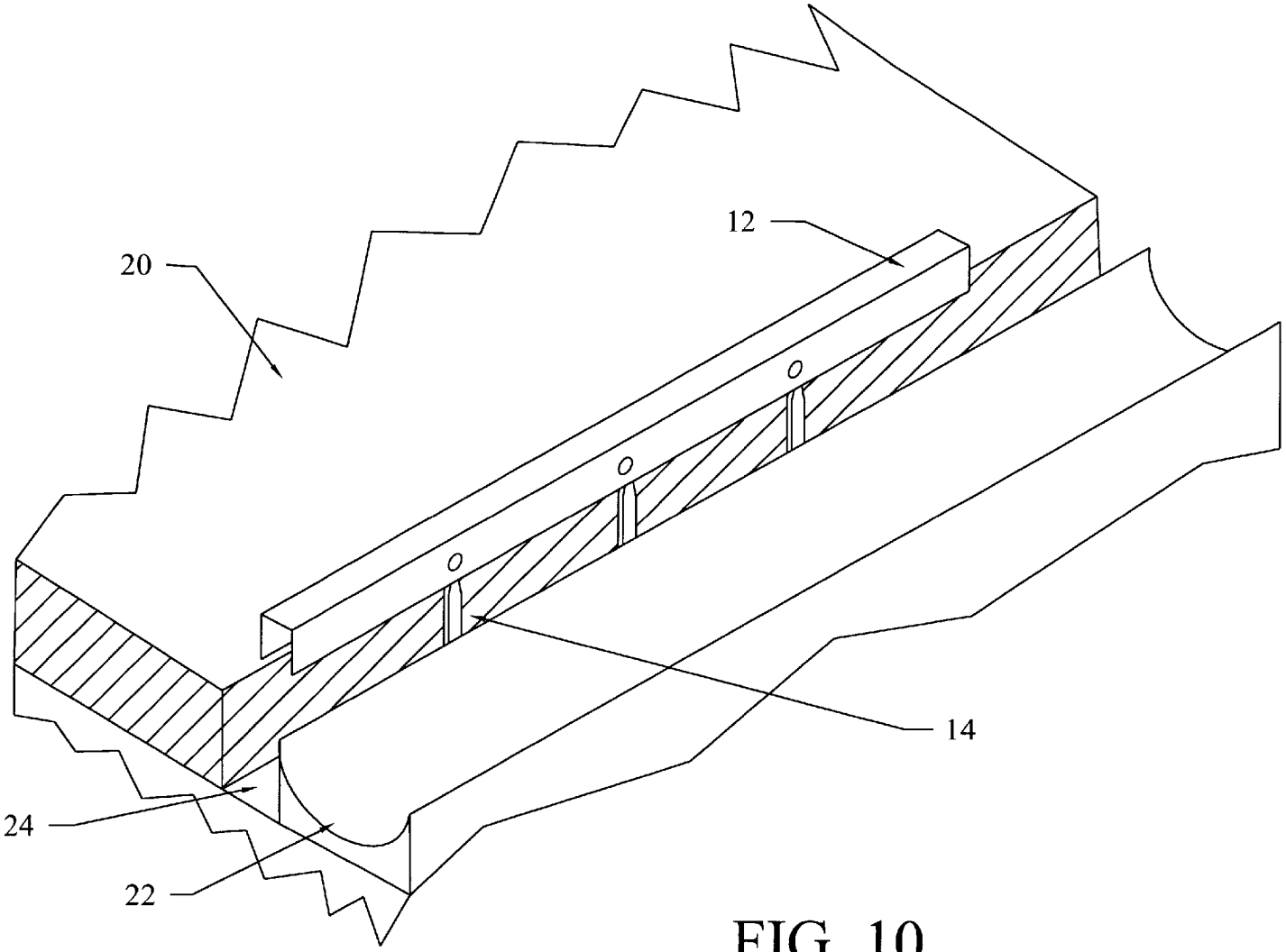
FIG. 10 depicts a perspective view of the bumper system installed on a lane in an erect position.
Figure 11:
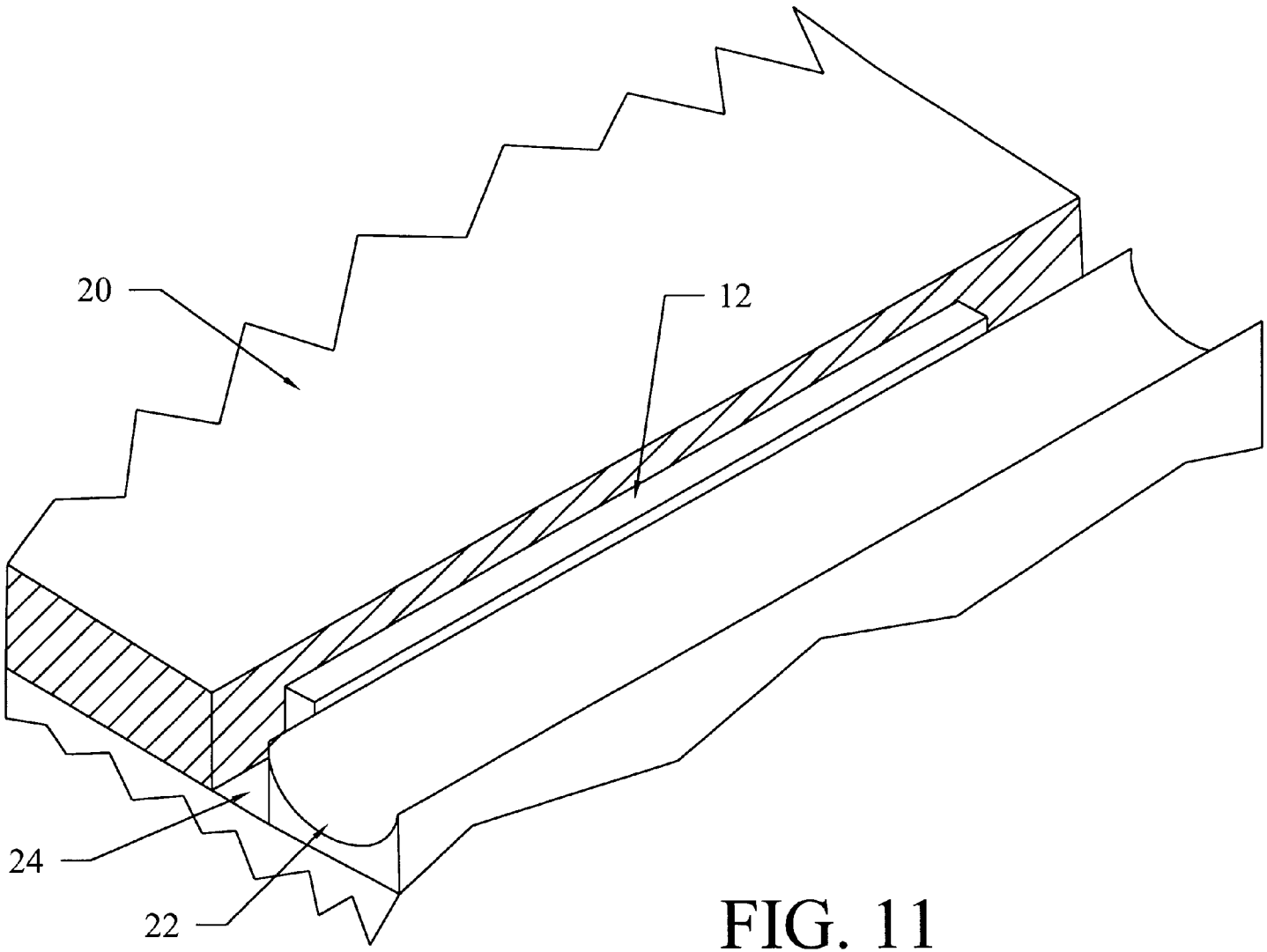
FIG. 11 depicts a perspective view of the bumper system installed on a lane in a retracted position.
Figure 12:
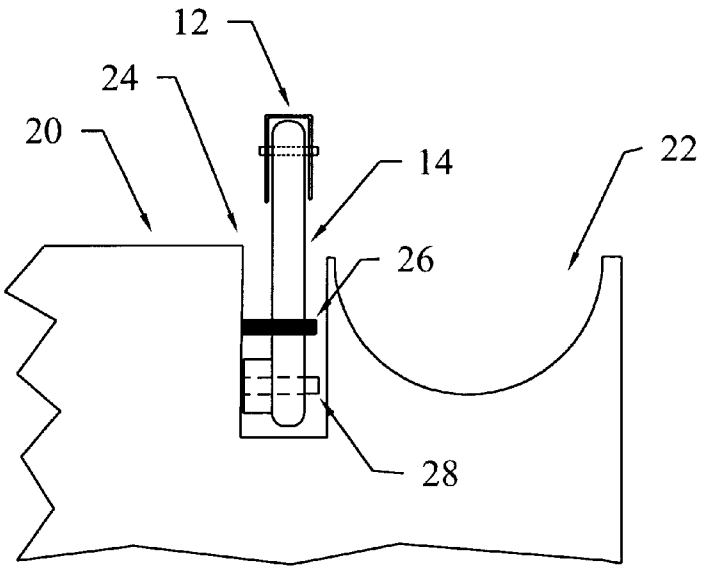
FIG. 12 depicts a front view of the bumper system install on a lane in an erect position.

As shown in FIGS. 10–12, the bumper system 10 affixed to the bowling alley 19 by forming a vertical side surface 24 in the lane bed 21 along the sides of the longitudinal lane 20.

In an embodiment, as shown in FIG. 12, the portion of the gutter 22 abutting the side of the lane 20 is removed, exposing the side of the lane bed 21, forming the vertical side surface 24, where the top of the gutter 22 is below the lane bed 21. The bumper system 10 is pivotally affixed to the vertical side surface 24 of the lane bed 21 by positioning the lower ends 16 of the pivot arms 14 against the vertical side surface 24, where the integrated bushings 18 are interposed between the pivot arms 14 and the vertical side surface 24. The pivot arms 14 are pivotally affixed to the vertical side surface 24 of the lane bed 21 by a pin, shaft, or other similar connection device so as to move in paired unison with the displacement of the longitudinal rail 12. In this manner, the longitudinal rails 12 can be displaced between the retracted position for exposing the adjacent gutter 22 and the fully extended position guarding the adjacent gutter 22.

In an alternative embodiment, the bumper system 10 is affixed to the bowling alley 19 by initially removing the entire gutter 22. An alternative gutter 22 is installed which leaves exposed the side of the lane bed 21, forming a vertical side surface 24. The bumper system 10 is pivotally affixed to the vertical side surface 24 of the lane bed 21 by positioning the lower ends 16 of the pivot arms 14 against the vertical side surface 24, where the integrated bushings 18 are interposed between die pivot arms 14 and the vertical side surface 24. The pivot arms 14 are pivotally affixed to the vertical side surface 24 of die lane bed 21 by a pin, shaft, or other similar connection device so as to move in paired unison with the displacement of the longitudinal rail 12. In this manner, the longitudinal rails 12 can be displaced between the retracted position for exposing the adjacent gutter 22 and die fully extended position guarding the adjacent gutter 22.

Figure 13:
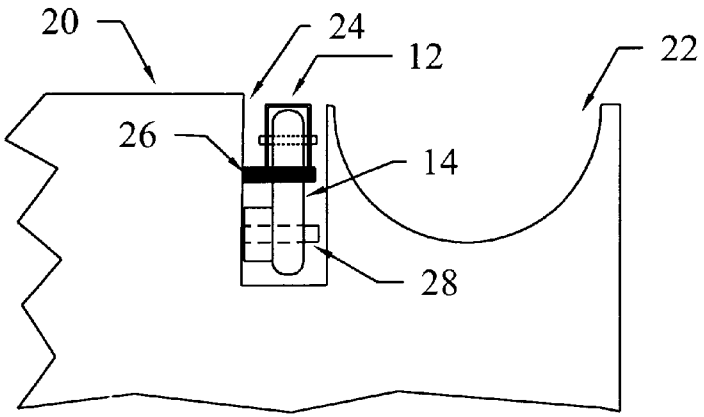
FIG. 13 depicts a front view of the bumper system install on a lane in an retracted position.

As shown in FIGS. 11 and 13, the pivot arms 14 are positioned along the vertical side surface 24 of the lane bed 21 such that when the bumper system 10 is in a retracted position the horizontal surface 13 of the longitudinal rails 12 are in a substantially abutting relation to the side of the lane 20 and the top of the adjacent gutters 22, such that the adjacent gutters 22 are adapted to receive any balls that are bowled towards either side of the lane 20, directing die balls to the end of die lane 20, missing the pin deck 25. As shown in FIGS. 10 and 12, in an extended position the longitudinal rails 12 prevents the balls from entering the adjacent gutters 22, redirecting balls into the lane 20, such that the balls strike the pins in the pin deck 25.

In an embodiment, die bumper system 10 is deployed by manually displacing the longitudinal rails 12, which rotates die attached pivot arms 14. The longitudinal rails 12 are displaced until the pivot arms 14 engage die stop mechanism 26. The stop mechanism 26 comprises a shaft inserted into the vertical side surface 24 of the lane bed 21, thereby limiting the rotation of the pivot arms 14 to that of greater than ninety degrees.

In alternative embodiment longitudinal rail 12 can be displaced by mechanical, electrical, or pneumatic displacement systems, a will be readily apparent to the skilled artisan.

All patents, patent applications and publications referred to or cited herein, or from which a claim for benefit of priority has been made, are incorporated by reference in their entirety to die extent they arc not inconsistent with the explicit teachings of this specification, including: U.S. Pat. No. 4,900,024; U.S. Pat. No. 5,181,716; U.S. Pat. No. 5,207,422; U.S. Pat. No. 5,304,097; U.S. Pat. No. 5,322,476; U.S. Pat. No. 5,358,448; U.S. Pat. No. 45,405,295; U.S. Pat. No. 5,415.591; U.S. Pat. No. 5,417,616; U.S. Pat. No. 5,435,788; U.S. Pat. No. RE. 35,232; U.S. Pat. No. 5,564, 986; U.S. Pat. No. 5,681,224; U.S. Pat. No. 5,800,274; and U.S. Pat. No. 5,857,918.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A bowling alley comprising:

a) a longitudinally extending lane disposed over a lane bed, wherein said longitudinally extending lane defines a flat horizontal bowling surface comprising a pin deck at one end;

b) a pair of vertical side surfaces longitudinally extending along the sides of said lane bed, perpendicular to said flat horizontal surface, wherein a first vertical side surface extends along a first side of said lane bed and a second vertical side surface extends parallel to said first vertical side surface along an opposite side of said lane bed;

c) a pair of longitudinally extending gutters disposed along said vertical side surfaces, wherein a first longitudinally extending gutter is disposed along a bottom edge of said first vertical side surface and a second longitudinally extending gutter is disposed along a bottom edge of said second vertical side surface;

d) a bumper system comprising a pair of retractable bumpers, each of said retractable bumpers comprising at least one longitudinal rail and a plurality of pivot arms, each of said pivot arms comprising a top end and a bottom end, wherein said top end is pivotally affixed to said longitudinal rail and said bottom end comprising an integrated bushing, wherein a first retractable bumper is pivotally affixed to said first vertical side surface and a second retractable bumper is pivotally affixed to said second vertical side surface, such that said integrated bushings are disposed between said pivot arms and the associated vertical side surface; and e) at least one stop mechanism affixed to each of said first and said second vertical side surface, such that said stop mechanisms limits the rotation of said pivot arms.

2. A bowling alley according to claim 1, further comprising a means for extending and retracting said retractable bumpers.

3. A bowling alley according to claim 1, wherein said retractable bumpers comprise one longitudinal rail having a length substantially equal to the length of said longitudinally extending lane.

4. A bowling alley according to claim 1, wherein each of said retractable bumpers comprises a plurality of longitudinal rails, wherein said longitudinal rails are affixed together in series, such that the combined length of said longitudinal rails is substantially equal to the length of said longitudinally extending lane.

5. A bowling alley according to claim 4, wherein each of said longitudinal rails has a length of about one hundred sixteen inches.

6. A bowling alley according to claim 1, wherein said longitudinal rails are u-shaped comprising a pair of vertical side members affixed to a horizontal top member, such that said vertical side member form an open bottom, wherein said top end of said pivot arm is pivotally affixed to said vertical side members within said open end of said u-shaped longitudinal rails.

7. A bowling alley according to claim 1, wherein said longitudinal rails are L-shaped comprising a vertical side member affixed to a top horizontal member, wherein said top end of said pivot arm is pivotally affixed to said vertical side member such that said vertical side member is directed into said longitudinal extending lane.

8. A bowling alley according to claim 1, wherein said longitudinal rails are made from a material selected from the group consisting of aluminum, plastic, and carbon composite.

9. A bowling alley according to claim 1, wherein said longitudinal rails comprise a light emitting material, wherein said light emitting material is a luminescent or phosphorescent material.

10. A bowling alley according to claim 1, wherein said pivot arms are made from a resilient material.

11. A bowling alley according to claim 1, wherein said pivot arms are made from a material selected from the group consisting of resilient plastic, anodized rubber, and carbon composite.

12. A bowling alley according to claim 1, wherein said pivot arms comprise a light emitting material, wherein said light emitting material is a luminescent or phosphorescent material.

13. A bowling alley comprising:

a) a longitudinally extending lane disposed over a lane bed, wherein said longitudinally extending lane defines a flat horizontal bowling surface comprising a pin deck at one end;

b) a pair of vertical side surfaces longitudinally extending along the sides of said lane bed, perpendicular to said flat horizontal surface, wherein a first vertical side surface extends along a first side of said lane bed and a second vertical side surface extends parallel to said first vertical side surface along an opposite side of said lane bed;

c) a pair of longitudinally extending gutters disposed along said vertical side surfaces, wherein a first longitudinally extending gutter is disposed along a bottom edge of said first vertical side surface and a second longitudinally extending gutter is disposed along a bottom edge of said second vertical side surface;

d) a bumper system comprising a pair of retractable bumpers, each of said retractable bumpers comprising at least one longitudinal rail and a plurality of resilient pivot arms, each of said resilient pivot arms comprising a top end and a bottom end, wherein said top end is pivotally affixed to said longitudinal rail and said bottom end comprising an integrated bushing, wherein a first retractable bumper is pivotally affixed to said first vertical side surface and a second retractable bumper is pivotally affixed to said second vertical side surface, such that said integrated bushings are disposed between said resilient pivot arms and the associated vertical side surface;

e) at least one stop mechanism affixed to each of said first and said second vertical side surface, such that said stop mechanisms limit the rotation of said resilient pivot arms; and f) a means for extending and retracting said retractable bumpers.

14. A bowling alley comprising:

a) a longitudinally extending lane disposed over a lane bed, wherein said longitudinally extending lane defines a flat horizontal bowling surface comprising a pin deck at one end;

b) a pair of vertical side surfaces longitudinally extending along the sides of said lane bed, perpendicular to said flat horizontal surface, wherein a first vertical side surface extends along a first side of said lane bed and a second vertical side surface extends parallel to said first vertical side surface along an opposite side of said lane bed;

c) a pair of longitudinally extending gutters disposed along said vertical side surfaces, wherein a first longitudinally extending gutter is disposed along a bottom edge of said first vertical side surface and a second longitudinally extending gutter is disposed along a bottom edge of said second vertical side surface;

d) a bumper system comprising a pair of retractable bumpers, each of said retractable bumpers comprising at least one u-shaped longitudinal rail and a plurality of resilient pivot arms, each of said u-shaped longitudinal rails comprising a pair of vertical side members affixed to a horizontal top member, wherein said vertical side members form an open bottom, and each of said resilient pivot arms comprising a top end and a bottom end, wherein said top end is pivotally affixed to at least one vertical side member, within said open end of said u-shaped longitudinal rails, and said bottom end comprising an integrated bushing, wherein a first retractable bumper is pivotally affixed to said first vertical side surface and a second retractable bumper is pivotally affixed to said second vertical side surface, such that said integrated bushings are disposed between said resilient pivot arms and the associated vertical side surface; and e) at least one stop mechanism affixed to each of said first and said second vertical side surface, such that said stop mechanisms limits the rotation of said resilient pivot arms.

15. A bumper system for a bowling alley, where the bowling alley has a longitudinally extending lane disposed over a lane bed, wherein the longitudinally extending lane defines a flat horizontal bowling surface, a pair of vertical side surfaces longitudinally extending along the sides of the lane bed, perpendicular to said the flat horizontal surface, wherein a first vertical side surface extends along a first side of the lane bed and a second vertical side surface extends parallel to the first vertical side surface along an opposite side of the lane bed, and a pair of longitudinally extending gutters disposed along the vertical side surfaces, wherein a first longitudinally extending gutter is disposed along a bottom edge of the first vertical side surface and a second longitudinally extending gutter is disposed along a bottom edge of the second vertical side surface; comprising a) a pair of retractable bumpers, each of said retractable bumpers comprising at least one u-shaped longitudinal rail and a plurality of resilient pivot arms, each of said u-shaped longitudinal rails comprising a pair of vertical side members affixed to a horizontal top member, wherein said vertical side members form an open bottom, and each of said resilient pivot arms comprising a top end and a bottom end, wherein said top end is pivotally affixed to at least one vertical side member, within said open end of said u-shaped longitudinal rails, and said bottom end comprising an integrated bushing, such that said integrated bushings are disposed between said resilient pivot arms and the associated vertical side surface; and b) at least one stop mechanism affixed to each of the first and said second vertical side surface, such that said stop mechanisms limits the rotation of said resilient pivot arms.

* * * * *